US008585457B2

(12) United States Patent
Missler et al.

(10) Patent No.: US 8,585,457 B2
(45) **Date of Patent: *Nov. 19, 2013**

(54) CONTROL OF ADDITIONAL FUNCTIONS OF TOY VEHICLES IN A DIGITAL CONTROL SYSTEM

(75) Inventors: Roman Missler, Lebach (DE); Uwe Haass, Darmstadt (DE)

(73) Assignee: Stadlbauer Spiel—und Freizeitartikel GmbH, Nuremberg (DE)

( * ) Notice: Subject to any disclaimer, the term of this patent is extended or adjusted under 35 U.S.C. 154(b) by 932 days.

This patent is subject to a terminal disclaimer.

(21) Appl. No.: 12/300,719

(22) PCT Filed: Apr. 17, 2007

(86) PCT No.: PCT/EP2007/003373

§ 371 (c)(1),
(2), (4) Date: Nov. 13, 2008

(87) PCT Pub. No.: WO2007/131587

PCT Pub. Date: Nov. 22, 2007

(65) Prior Publication Data

US 2009/0130951 A1 May 21, 2009

(30) Foreign Application Priority Data

May 17, 2006 (DE) ..... 10 2006 023 132

(51) Int. Cl.
*A63H 17/00* (2006.01)

(52) U.S. Cl.
USPC ..... 446/444; 446/456; 446/465; 246/3

(58) Field of Classification Search
USPC ..... 446/454–456, 444–446; 246/2 R, 3
See application file for complete search history.

(56) References Cited

U.S. PATENT DOCUMENTS

| | | | | |
|---|---|---|---|---|
| 6,320,346 | B1 | 11/2001 | Graf | |
| 6,539,292 | B1 | 3/2003 | Ames, Jr. | |
| 7,210,656 | B2 * | 5/2007 | Wolf et al. | 246/4 |
| 2003/0148703 | A1 * | 8/2003 | Scott et al. | 446/456 |
| 2003/0155470 | A1 * | 8/2003 | Young et al. | 246/122 A |

(Continued)

FOREIGN PATENT DOCUMENTS

| | | |
|---|---|---|
| DE | 29 31 524 A1 | 2/1981 |
| DE | 30 09 557 A1 | 9/1981 |

(Continued)

*Primary Examiner* — William M. Brewster
*Assistant Examiner* — Alex F. R. P. Rada, II
(74) *Attorney, Agent, or Firm* — DeLio & Peterson, LLC; Robert Curcio

(57) ABSTRACT

The invention relates to a method for operating a digital control system for several objects to be controlled, in particular for track-guided toy vehicles on a car racing track, with in each case at least one digital decoder in each object to be controlled and with several operating devices, which each have at least one activation element for controlling an object assigned to the operating device. The assignment of the operating device to an object is set up by a digital address being assigned to each operating device. The digital decoder, depending on the status information of the activation element of the assigned operating device, transmits control commands to the toy vehicle. By this process, the digital decoder selects the control commands derived from the status information for the toy vehicle, depending additionally on the physical state of the toy vehicle.

6 Claims, 1 Drawing Sheet

(56) References Cited

U.S. PATENT DOCUMENTS

| | | | | |
|---|---|---|---|---|
| 2004/0147202 | A1* | 7/2004 | Brabrand | 446/454 |
| 2005/0023416 | A1* | 2/2005 | Wolf et al. | 246/167 R |
| 2005/0092868 | A1 | 5/2005 | Katzer | |
| 2005/0103946 | A1 | 5/2005 | Lenz | |
| 2006/0148579 | A1* | 7/2006 | Arnaum Manresa et al. | 463/58 |

FOREIGN PATENT DOCUMENTS

| | | | |
|---|---|---|---|
| DE | 197 20 888 | A1 | 4/1997 |
| DE | 200 05 174 | U1 | 6/2000 |
| DE | 103 02 581 | A1 | 8/2004 |
| DE | 10 2004 016636 | A1 | 10/2005 |

* cited by examiner

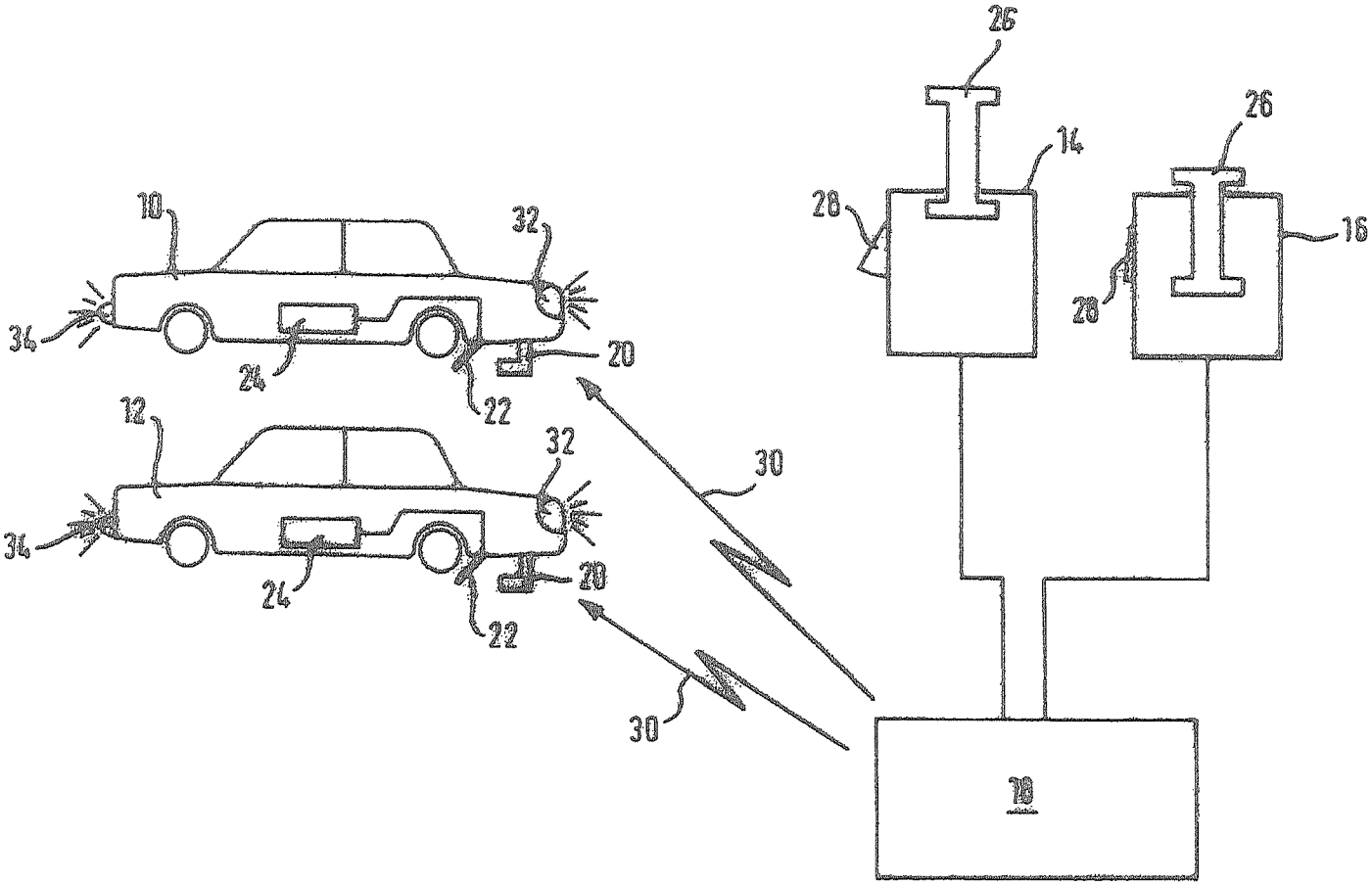
16
26
28
14
26
28
18
30
30
20
32
22
24
10
34
20
32
22
24
12
34

CONTROL OF ADDITIONAL FUNCTIONS OF TOY VEHICLES IN A DIGITAL CONTROL SYSTEM

This is a National Phase filing of PCT Application No. PCT/EP2007/003373 filed Apr. 17, 2007, which claims priority from German Application No. DE 10 2006 023 132.5 filed May 17, 2006.

This invention concerns a process for operating a digital control system for several objects to be controlled, in particular for track-guided toy vehicles on a car race track, with at least one digital decoder in each object to be controlled and with several operating devices, which in each case have at least one actuating element for controlling one of the objects assigned to the operating device, where digitally encoded data packets can be transmitted to the digital decoders, which contain in each case at least status information of the at least one actuating element of an operating device, as well as a digital address which creates the assignment between the operating device and an object, in that each operating device is assigned a digital address and the digital address of the operating device to which the object is assigned is stored in the digital decoder, where the digital decoder selects the control commands for the toy vehicle, depending upon the status data of the actuating elements of the assigned operating device in a digitally encoded data packet with the same digital address stored in the digital decoder, and transmits them to the toy vehicle in accordance with the main clause in Claim 1.

It is known, for example, in the case of model railroads, how to control additional functions of locomotives, for example, switching a headlight on and off or the extension/retraction of a current contact by means of switches on an operating device permanently assigned to this additional function. However, this has the disadvantage that its own switch must be provided on the operating unit for each additional function.

The problem to be solved by the invention is to improve a process of the above-mentioned type in such a manner that additional functions of objects to be controlled can be controlled simply and intuitively by a player without a large number of switches.

This problem is solved in accordance with the invention by a process of the above-mentioned type, with the characteristics characterized in Claim 1. Advantageous embodiments of the invention are described in the further claims.

In the case of a process of the above-mentioned type, it is provided in accordance with the invention for the digital decoder to select the control commands derived from the status data for the toy vehicle additionally depending upon a physical condition of the toy vehicle.

This has the advantage that one of the same actuating elements can have several functions on an operating unit, so that additional functions of the toy vehicle can be controlled by actuating elements already present in the operating unit, without the need of providing additional actuating elements on the operating units for these additional functions.

For example, the physical condition may be a speed of operation of the toy vehicle or a position of the toy vehicle on a race track.

In a preferred embodiment, the digital decoder switches a predetermined additional function of the toy vehicle on or off only when a predetermined physical status of the toy vehicle is present, depending upon the actuation of a predetermined actuating element of the operating unit.

The predetermined physical status of the toy vehicle is, for example, a momentary speed v of the toy vehicle with v=0.

The additional function is for example a light or lights on the toy vehicle, especially headlights, taillights and/or an interior light of the toy vehicle, as well as additional lighting elements and/or drives.

The invention will be described in greater detail in the following on the basis of the drawing.

This shows in its sole FIGURE an exemplary schematic representation of a digital control system for track-guided toy vehicles.

In the following, the invention will be described only as an example on the basis of a digital control system for a track-guided toy vehicle. The invention however is not limited to track-guided toy vehicles, but can be applied to any type of digital control of objects to be controlled, thus, for example, even to the transmission of control data to toy vehicles through a radio band on a common frequency.

The digital control system for track-guided toy vehicles 10, 12 represented in the sole FIGURE includes the operating devices 14 and 16, hereinafter called manual control units, which are connected to a control center 18. Each toy vehicle 10, 12 has a guide keel 20, current contact 22 and a digital decoder 24. The guide keel 20 is shaped so as to fit into a guide slot of a car race track that is not shown. On the car race track, next to each guide slot, two or more current rails are arranged in a known manner, so that when a toy vehicle 10, 12 is placed on the car race track, the current contact 22 establishes an electrical contact with the current rails. By means of the current rails and the current contact, the toy vehicle 10, 12, the digital decoder 24 and further electrical components as well as a drive motor (not shown) are supplied with electrical power.

Each operating device 14, 16 has a first actuating element in the form of a pestle 26 and a second actuating element in the form of a switch 28. The pestle 26 can be moved manually without intermediate stops between a first position in which it protrudes from the operating device 14, 16 and a second position in which it is pushed into the operating device 14, 16. In this connection, the pestle 26 is subjected to a spring force which presses the pestle 26 into the first position and which can be manually moved counter to the spring force without steps to the second position. The switch 28 can be manually switched between a first and a second position, where a spring force presses the switch toward the first position. And it can be manually pressed against the spring force into the second position by means of a manual actuation. In the case of one of the operating devices 14, represented in the sole FIGURE, the actuating elements pestle 26 and switch 28 are each in the first position, that is, in the position without any manual actuation, and in the case of the other operating device 16 represented in the sole FIGURE, the pestle 26 and switch 28 actuating elements are each in the second position, having been manually actuated by a player.

In a known manner, the control of the toy vehicles 10, 12 by means of the operating device 14, 16 is accomplished in such a manner that the speed of the toy vehicles 10, 12 is controlled using the pestle 26. The further the pestle 26 is pressed into the operating device 14, 16, the higher the speed of the toy vehicle 10, 12 assigned to this operating device 14, 16. In the second position of the pestle 26, the toy vehicle 10, 12 assigned to it reaches its maximum speed, and in the first position of the pestle 26, the toy vehicle 10, 12 has a speed of 0, that is, the toy vehicle 10, 12 is standing still.

The manual actuation of the switch 28 into the second position causes the next turning point on the car race track to switch when the toy vehicle 10, 12 passes through it, so that the toy vehicle changes tracks, that is, the guiding slot.

In the digital control system, each operating device 14, 16 is unambiguously assigned to a toy vehicle 10, 12 so that each player who holds an operating device 14, 16 in his hand controls a toy vehicle 10, 12 through the car race track. For this purpose, the operating devices 14, 16 are connected to the control center 18. This latter converts the settings of the actuating elements 26, 28 of each operating device 14, 16 into digitally encoded signals and adds to each digitally encoded signal or data packet a digital address which identifies a certain operating device 14, 16. The control center 18 sends the data packets through the current rails of the race track as symbolized with the arrows 30, so that these are received in each toy vehicle 10, 12 through the current contact 22 and forwarded to each digital decoder 24. In the digital decoders 24, the digitally encoded signals or data packets are evaluated where first each digital address is read. In each digital decoder 24, a digital address is stored and the digital decoder 24 compares the digital address of each data packet received with the stored digital address. If the two coincide, then the digital decoder identifies the corresponding data packet as belonging to this toy vehicle 10, 12 and applies the digitally encoded data contained in the data packet. Corresponding to or dependent upon these data and the status data of the actuating elements 26, 28 of the operating devices 14, 16, the digital decoder 24 selects the control commands for the toy vehicle and forwards these to the toy vehicle 10, 12. These control commands concern, for example, the driving speed, that is, the more the pestle 26 is moved from the first position in the direction of the second position, the more the drive motor of the toy vehicle 10, 12 is supplied with a higher drive voltage.

The state of the switch 28 is either ignored by the digital decoder 24 or, depending upon the actuation of the switch 28 by a player or at the option of a player, a recognition of the toy vehicle 10, 12 is transmitted, for example, by means of an infrared diode in the toy vehicle 10, 12.

The toy vehicle 10, 12 has a further additional function in the form of headlights 32 and taillights 34. These may optionally be turned off and on.

The invention provides for the digital decoder to switch on or off the lights 32, 34 upon actuation of the switch 28 when the toy vehicle 10, 12 has a driving speed of zero, that is, when the toy vehicle 10, 12 is standing still. As a result, the switch 28 has two functions, where one of these functions, namely the switching of the lights 34, 34 is achieved depending upon the vehicle speed. In other words, the digital decoder 24 selects the control commands for the toy vehicle 10, 12 not only as a function of the status data of the actuating elements 26, 28, but also as a function of the speed of the toy vehicle 10, 12. When the toy vehicle 10, 12 is in motion, actuating the switch 28 does not switch the lights, since the zero speed condition is not fulfilled. Therefore, when the toy vehicle 10, 12 is in motion, the switch 28 can still be used without affecting the functioning of the lights 34, 34.

The digital decoder determines a "zero" speed of the toy vehicle for example by using a simulation of inertia, by beginning with the last voltage level applied to the drive motor of the toy vehicle 10, 12, which corresponds directly to a certain speed of the toy vehicle 10, 12. Depending upon this last speed of the toy vehicle 10, 12 before the pestle 26 is completely released and automatically returns to the first position, the digital decoder 24 selects a predetermined time period which must pass before the toy vehicle 10, 12 rolls to a complete stop. Only after this predetermined time has elapsed does the digital decoder 24 assume that the toy vehicle 10, 12 is standing still (v=0) and selects the switching of the additional function "lights" as an answer to the actuation of switch 28.

In a simpler embodiment, the digital decoder 24 always assumes a fixed time constant which covers the case of the deceleration from maximum speed at the time of release of the pestle 26, so that in any case it is assured that the toy vehicle 10, 12 has rolled to a stop after the expiration of the fixed time constant.

The invention claimed is:

1. Process for operating a digital control system for several objects to be controlled, in particular for track-guided toy vehicles on a car race track, comprising at least one digital decoder in each object to be controlled and an operating device for each object to be controlled, said operating device connected to a control center, and including digitally converting the settings of at least one manually operated actuating element for controlling one of the objects assigned to the operating device, wherein digitally encoded data packets are transmitted to the digital decoders via the control center, said data packets contain in each case at least status information of at least one actuating element of an operating device, and a digital address which creates the assignment between the operating device and one of the objects is transmitted to the digital decoders wherein each operating device is assigned a digital address and the digital address of the operating device to which the object is assigned is stored in the digital decoder, where using one of the digitally encoded data packets, depending upon status data of the actuating elements of the assigned operating device in said one of the digitally encoded data packet with the same digital address stored in the digital decoder, the digital decoder selects the control commands for the toy vehicle derived from said status data and depending upon a physical status of the toy vehicle, and transmits the control commands to the toy vehicle.

2. The process of claim 1 wherein the physical status is a vehicle speed of the vehicle or a position of the vehicle on a race track.

3. The process of claim 1 wherein the digital decoder, depending upon an actuation of a predetermined actuating element of the operating device, switches on or off a predetermined additional function of the toy vehicle only when a predetermined physical status of the toy vehicle is present.

4. The process of claim 3 wherein the predetermined physical status of the toy vehicle is momentary speed v of the toy vehicle with v=0.

5. The process of claim 3 including having the additional function as a light or lights on the toy vehicle, especially headlights, taillights and/or interior lighting of the vehicle.

6. The process of claim 2 wherein the digital decoder, depending upon an actuation of a predetermined actuating element of the operating device, switches on or off a predetermined additional function of the toy vehicle only when a predetermined physical status of the toy vehicle is present.

* * * * *